US008285182B2

(12) United States Patent
Aratachi et al.

(10) Patent No.: US 8,285,182 B2
(45) Date of Patent: Oct. 9, 2012

(54) FIXING DEVICE USED FOR IMAGE FORMING DEVICE WITH HEATING ROLLER AND PEELER

(75) Inventors: Tomitake Aratachi, Nagoya (JP); Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 516 days.

(21) Appl. No.: 11/947,196

(22) Filed: Nov. 29, 2007

(65) Prior Publication Data

US 2008/0131177 A1 Jun. 5, 2008

(30) Foreign Application Priority Data

Nov. 30, 2006 (JP) ..... 2006-323809

(51) Int. Cl.
*G03G 15/20* (2006.01)
*G03G 15/00* (2006.01)

(52) U.S. Cl. ..... 399/323; 399/22

(58) Field of Classification Search ..... 399/21, 399/22, 322, 323; 219/216, 469–471
See application file for complete search history.

(56) References Cited

U.S. PATENT DOCUMENTS

| | | | | |
|---|---|---|---|---|
| 5,517,292 | A * | 5/1996 | Yajima et al. | 399/323 |
| 5,802,434 | A | 9/1998 | Takehara et al. | |
| 6,205,316 | B1 | 3/2001 | Iida | |
| 6,259,881 | B1 | 7/2001 | Nakamura | |
| 6,658,229 | B2 * | 12/2003 | Ando et al. | 399/323 |
| 2001/0036377 | A1 * | 11/2001 | Tsujihara | 399/322 |
| 2002/0025204 | A1 | 2/2002 | Ando et al. | |
| 2004/0067079 | A1 | 4/2004 | Kuo et al. | |
| 2005/0008408 | A1 | 1/2005 | Inomata | |
| 2005/0089352 | A1 * | 4/2005 | Lee et al. | 399/322 |
| 2006/0177249 | A1 * | 8/2006 | Aratachi et al. | 399/323 |
| 2007/0048036 | A1 * | 3/2007 | Kanematsu et al. | 399/323 |

FOREIGN PATENT DOCUMENTS

| | | |
|---|---|---|
| JP | 57-164769 | 4/1956 |
| JP | 60-189781 A | 9/1985 |
| JP | 61-200564 | 9/1986 |
| JP | 61-200564 A | 9/1986 |
| JP | 62-118254 | 7/1987 |

(Continued)

OTHER PUBLICATIONS

Chinese Office Action dated Apr. 24, 2009 for Application No. 200710194673.5 with translation.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A fixing device has a frame, a heating roller, a press roller, a peeler, a guide member, and a wheel. The heating roller includes a roller rotation axis and a cylindrical surface. The press roller is pressed against the cylindrical surface to feed a recording medium together with the heating roller along a feeding path. The peeler has a peeling surface having a leading edge, where the peeling surface faces the feeding path. The guide member faces the peeling surface to guide the recording medium to downstream of the feeding path. The guide member is movable between a near position and a far position relative to the peeling surface. The wheel is positioned in a manner that a part of the circumferential edge protrudes from the peeling surface to the guiding member in a virtual plane perpendicular to the wheel rotation axis.

25 Claims, 9 Drawing Sheets

FOREIGN PATENT DOCUMENTS

| | | | |
|---|---|---|---|
| JP | 63-058474 | A | 3/1988 |
| JP | 63-057677 | | 4/1988 |
| JP | 02-286541 | A | 11/1990 |
| JP | 05-307336 | A | 11/1993 |
| JP | 06-011992 | A | 1/1994 |
| JP | 7225527 | | 8/1995 |
| JP | 08-179652 | A | 7/1996 |
| JP | 08-278717 | | 10/1996 |
| JP | 09-190103 | A | 7/1997 |
| JP | 11-338297 | A | 12/1999 |
| JP | 2001222182 | | 8/2001 |
| JP | 2003-162166 | | 6/2003 |
| JP | 2003-270995 | | 9/2003 |
| JP | 2003270995 | A * | 9/2003 |
| JP | 2005-024898 | | 1/2005 |

OTHER PUBLICATIONS

Search Report received for corresponding European Application 07023090.9-1240, mailed Jul. 2, 2010.

English translation of Office Action regarding Japanese Patent Application No. 2007-305382 Mailed Mar. 13, 2012, pp. 1 and 2.

* cited by examiner

FIXING DEVICE USED FOR IMAGE FORMING DEVICE WITH HEATING ROLLER AND PEELER

CROSS REFERENCE TO RELATED APPLICATION

This application claims priority from Japanese Patent Application No. 2006-323809 filed on Nov. 30, 2006. The entire content of this priority application is incorporated herein by reference.

TECHNICAL FIELD

The present invention relates to a fixing device for thermally fixing an image onto a recording sheet, and an image forming device provided with such a fixing device.

BACKGROUND

Generally, a well-known fixing device used for an image forming device includes a heating roller heated by an internal heat source, a press roller for holding a recording sheet together with the heating roller, and a peeling claw facing the heating roller to peel off the recording sheet from the heating roller.

The fixing device feeds the recording sheet onto which a toner image has been transferred, holding the recording sheet between the heating roller and the press roller, to thermally fix the toner image onto the recording sheet. When the recording sheet having the toner image thereon is stuck to the cylindrical surface of the heating roller, the peeling claw is used to peel off the recording sheet from the surface of the heating roller.

When the recording sheet is jammed near the peeling claw, the jammed recording sheet frequently presses the peeling claw to the heating roller, which may cause damage on the cylindrical surface of the heating roller. In order to avoid the damage, Japanese Patent Application Publication S61-200564 discloses a peeling device in which the leading edge of the peeling claw is displaceably supported to the frame to remove away from the heating roller when the peeling claw is pressed by the jammed recording sheet. According to this configuration, even if the peeling claw is pressed by the jammed recording sheet, the leading edge of the peeling claw is moved away from the heating roller, thereby preventing any damage of the heating roller.

However, even if the above configuration is employed, the leading edge of the peeling claw is not always moved away from the heating roller, depending on the posture and/or the number of the recording sheets jammed near the peeling claw. In this case, the leading edge of the peeling claw may be forced to strongly press the heating roller, thereby causing damage thereto.

Therefore, an object of the present invention is to provide a fixing device which reliably prevents damage of the heating roller which may caused by the jammed recording paper jam.

SUMMARY

The present invention provides a fixing device having a frame, a heating roller, a press roller, a peeler, a guide member, a first bias unit, and a wheel. The heating roller is provided to the frame to produce heat, the heating roller having a roller rotation axis and a cylindrical surface. The press roller is pressed against the cylindrical surface to feed a recording medium together with the heating roller along a feeding path.

The peeler is provided to the frame having a peeling surface having a leading edge. The leading edge faces the cylindrical surface to peel off the recording medium on the cylindrical surface. The peeling surface faces the feeding path. The guide member is positioned facing the peeling surface to guide the recording medium which has passed through between the heating roller and the press roller to downstream of the feeding path. The guide member is movable between a near position and a far position, the near position being closer to the peeling surface than the far position. The first bias unit biases the guide member to the near position. The wheel is supported to the frame and having a wheel rotation axis and a circumferential edge. The wheel rotation axis is parallel to the roller rotation axis. The wheel is positioned in a manner that a part of the circumferential edge protrudes from the peeling surface to the guiding member in a virtual plane perpendicular to the wheel rotation axis.

The present invention provides a fixing device having a frame, a heating roller, a press roller, a peeler, a guide member, a first bias unit, and a rotation member. The heating roller is provided to the frame to produce heat. The heating roller has a roller rotation axis and a cylindrical surface. The press roller is pressed against the cylindrical surface to feed a recording medium together with the heating roller along a feeding path. The peeler is provided to the frame and having a peeling surface having a leading edge, the leading edge facing the cylindrical surface to peel off the recording medium on the cylindrical surface. The peeling surface faces the feeding path. The guide member is positioned facing the peeling surface to guide the recording medium which has passed through between the heating roller and the press roller to downstream of the feeding path. The guide member is movable between a near position and a far position. The near position is closer to the peeling surface than the far position. The first bias unit biases the guide member to the near position. The rotation member is supported to the frame and has a rotation axis and an outer circumference. The rotation axis is parallel to the roller rotation axis. The rotation member is positioned in a manner that a part of the outer circumference protrudes from the peeling surface to the guiding member in a virtual plane perpendicular to the wheel rotation axis.

BRIEF DESCRIPTION OF THE DRAWINGS

The particular features and advantages of the invention as well as other objects will become apparent from the following description taken in connection with the accompanying drawings, in which.

DETAILED DESCRIPTION

An embodiment according to the present invention will be described referring to the accompanying drawings. In the following description, the expressions "front", "rear", "above" and "below" are used to define the various parts when a fixing device is disposed in an orientation in which it is intended to be used. Directional arrows pointing four directions (front, rear, up, and down) shown in each drawing are used as the directions referred to in the following description.

Figure 1:
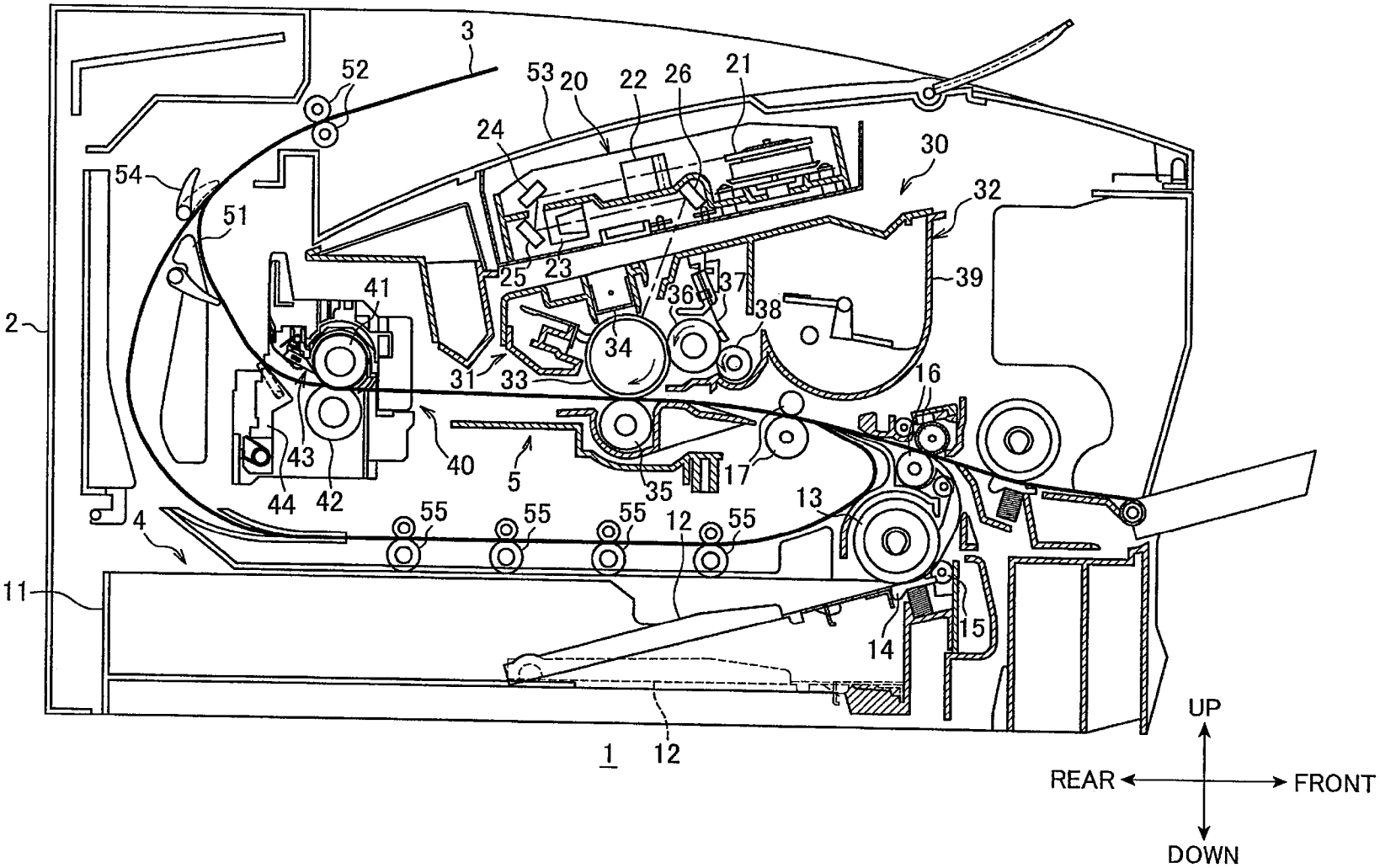
FIG. 1 is a side cross-sectional view showing a laser printer having a fixing device according to the present invention.

FIG. 1 shows a laser printer 1 having a sheet supply section 4 and an image forming section 5 in a main body casing 2. The sheet supply section 4 functions to supply a sheet 3, and has a sheet supply tray 11 detachably attached to the bottom portion inside the main body casing 2 and a sheet pressing plate 12 provided in the sheet supply tray 11. The sheet supply section 4 further has a sheet supply roller 13 and a sheet supply pad 14 which are provided in the upper portion of one end side of the sheet supply tray 11, and paper powder removing rollers 15, 16 provided on the downstream side relative to the sheet supply roller 13 in the feeding direction of the sheet 3. The sheet supply section 4 further has resist rollers 17, 17 provided on the downstream side relative to the paper powder removing rollers 15 and 16 in the sheet feeding direction.

In the sheet supply section 4 having the above configuration, the recording sheets 3 stacked in the sheet supply tray 11 are pressed to the sheet supply roller 13 by the sheet pressing plate 12, fed one by one by the sheet supply roller 13 and sheet supply pad 14, and finally supplied to the image forming section 5 by the rollers 13-16.

The image forming section 5 has a scanning unit 20, a process cartridge 30, and a fixing device 40 for forming an image onto the supplied sheet 3.

The scanner section 20 is provided at the upper portion inside the main body casing 2 and has a laser beam source (not shown), a rotatable polygon mirror 21, lenses 22, 23, and reflection mirrors 24, 25, and 26. A laser beam which is emitted from the laser beam source based on image data passes through the polygon mirror 21, the lens 22, the reflection mirrors 24, 25, the lens 23, and the reflection mirror 26 in the order mentioned and impinges on the surface of a photoconductive drum 33 in the process cartridge 30 through a high speed scanning process.

The process cartridge 30 is provided below the scanner section 20 and detachably attached to the main body casing 2. The process cartridge 30 includes a developer cartridge 32, the photoconductive drum 33, a scorotron charger 34, and a transfer roller 35 within a hollow casing 31.

The developer cartridge 32 is detachably attached to the casing 31 and has a developing roller 36, a layer thickness regulation blade 37, a supply roller 38, and a toner hopper 39. Toner in the toner hopper 39 is supplied to the developing roller 36 by the rotation of the supply roller 38 in the direction of an arrow (counterclockwise direction). The toner is frictionally charged positively between the supply roller 38 and the developing roller 36. The toner supplied on the developing roller 36 enters between the layer thickness regulation blade 37 and the developing roller 36 by the rotation of the developing roller 36 in the direction of an arrow (counterclockwise direction). The toner is then carried on the developing roller 36 to form a thin layer having a constant thickness.

The photoconductive drum 33 is supported to the casing 31 to rotate in the direction of an arrow (clockwise direction). The main body of the photoconductive drum 33 is grounded. The surface of the photoconductive drum 33 is formed from a positively charged photosensitive layer.

The scorotron charger 34 is disposed above the photoconductive drum 33 to face the photoconductive drum 33 separated therefrom by a given distance. The scorotron charger 34 is a charger for generating corona discharge from a charging wire of tungsten for positive charge and positively charging the surface of the photoconductive drum 33 uniformly.

The transfer roller 35 is disposed below the photoconductive drum 33 so as to face the photoconductive drum 33 in a contact manner with the photoconductive drum 33 and supported by the casing 31 so as to rotate in the direction of an arrow (counterclockwise direction). The transfer roller 35 has a roller shaft made of metal and a roller surface formed of electrically conductive rubber material that covers around the roller shaft. A transfer bias voltage is applied to the transfer roller 35 during a transfer process.

The surface of the photoconductive drum 33 is positively charged uniformly by the scorotron charger 34, and then is exposed to the laser beam by the high-speed scanning process from the scanner section 20. As a result, the potential of the exposed portion is decreased to form an electrostatic latent image based on image data. The "electrostatic latent image" refers to the area exposed by the laser beam and having a lowered electric potential in the surface of the photoconductive drum 33 that has been positively charged uniformly. Thereafter, when the toner carried on the developing roller 36 comes into contact with the photoconductive drum 33 by the rotation of the developing roller 36, the toner is supplied to the electrostatic latent image on the surface of the photoconductive drum 33. Then, the toner is carried on the electrostatic latent image on the photoconductive drum 33, so that the electrostatic latent image is visualized. In this manner, the toner image is formed by a reverse development method.

Thereafter, the photoconductive drum 33 and transfer roller 35 are rotatably driven so as to hold the sheet 3 for feeding. The toner image carried on the surface of the photoconductive drum 33 is transferred onto the sheet 3 while the sheet 3 passes between the photoconductive drum 33 and the transfer roller 35.

Figure 2:
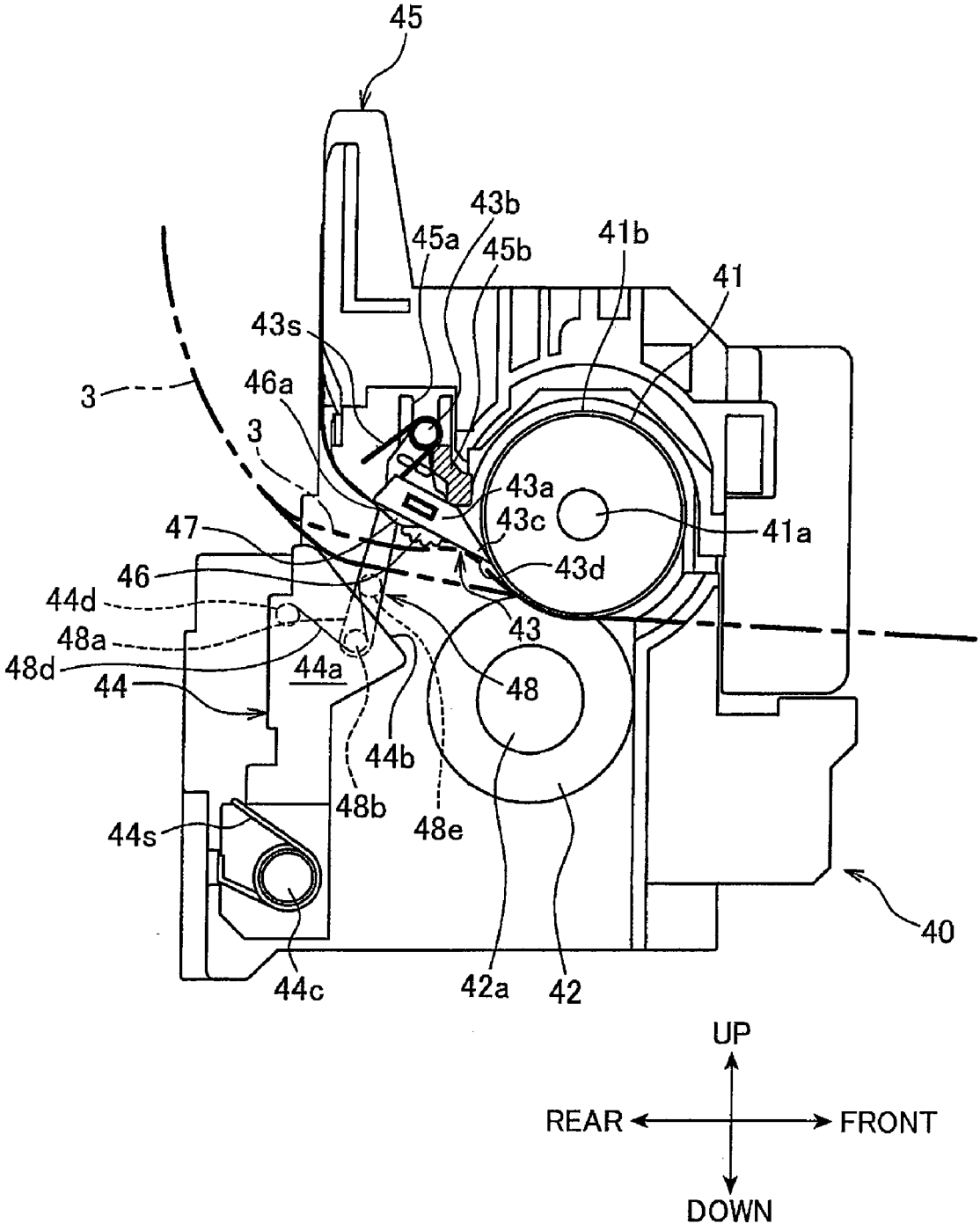
FIG. 2 is a side view showing the fixing device.

As shown in FIG. 2, the fixing device 40 is disposed on the sheet feeding direction on the downstream side relative to the process cartridge 30. The fixing device 40 has a heating roller 41, a press roller 42, a peeling claw 43, and a guide member 44 in a frame 45. The press roller 42 is disposed contacting with the heating roller 41 to hold the sheet 3 between the heating roller 41 and the press roller 42. The peeling claw 43 peels off the sheet 3 on the heating roller 41. The guide member 44 is provided on the downstream side relative to the heating roller 41 and press roller 42 in the sheet feeding direction.

The heating roller 41 is formed of a metal tube having a cylindrical surface 41*b* coated with a fluorine resin. The heating roller 41 includes a heater 41*a* made of a halogen lamp. The heating roller 41 is heated by the heater 41*a*. The heating roller 41 is rotated about a roller axis which is co-axial with the heater 41*a*. The heating roller 41 provides heat to the sheet 3 though the cylindrical surface 41*b*.

The press roller 42 is disposed below the heating roller 41 so as to face the heating roller 41 for pressing the cylindrical surface of the heating roller 41 using a biasing unit (not shown). The press roller 42 has a roller shaft 42*a* made of metal and a roller formed of a rubber material covering around the roller shaft. The press roller 42 is rotated, following the rotation of the heating roller 41.

The peeling claw 43 is movably supported to the frame 45. The frame 45 supports the heating roller 41, the press roller 42, the peeling claw 43, and the guide member 44. The frame 45 is assembled and fixed in the main body casing 2. The peeling claw 43 is provided for peeling off the sheet 3 from the heating roller 41 that has passed between the heating roller 41 and press roller 42, thereby preventing the sheet 3 from being caught by the heating roller 41 due to the sticking of the sheet 3 to the heating roller 41.

Figure 3:
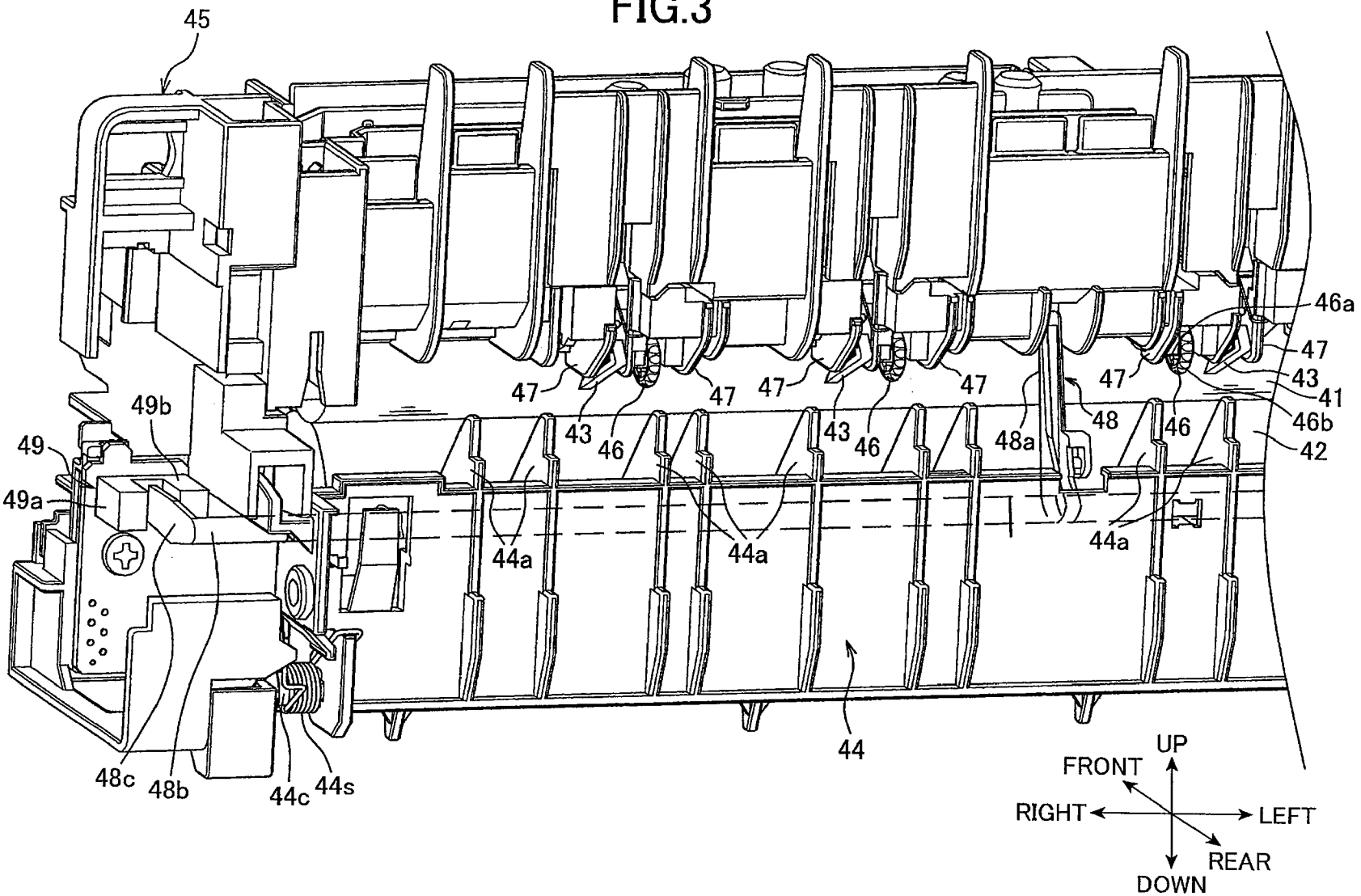
FIG. 3 is a perspective view of the fixing device.

As shown in FIG. 3, a plurality of peeling claws 43 are provided to the frame 45 and arranged in the axial direction of the heating roller 41. As shown in FIG. 2, the peeling claw 43 has a main body 43*a* and a pivotal shaft 43*b* provided near the upper end of the main body 43*a*. The main body 43*a* has a substantially triangular platy shape vertically. The main body 43*a* has a leading edge 43*c* tapered narrowly and directed to the heating roller 41. The leading edge 43*c* is configured to touch the cylindrical surface 41*b* of the heating roller 41 when a paper jam by the sheet 3 has not occurred near the peeling claw 43. The main body 43*a* has a lower surface which serves as a peeling surface 43*d* for guiding the sheet 3 that has been peeled from the heating roller 41 to the downstream of the sheet feeding direction. The pivotal shaft 43*b* is movably received in a groove 45*a* formed in the frame 45. The groove 45*a* extends in the vertical direction so as to be able to move the pivotal shaft 43*b* in the vertical direction. Thus, the peeling claw 43 is movably supported along the groove 45*a* to the frame 45. In a normal operation, the peeling claw 43 is supported and positioned at the lower end of the groove 45*a*. Accordingly, when an excessive load is applied to the peeling claw 43 from below, the peeling claw 43 can be moved upward along the groove 45*a*.

A torsion spring 43*s* is wound around the pivotal shaft 43*b*. One end of the torsion spring 43*s* is engaged to the frame 45, and the other end of the torsion spring 43*s* is engaged to the main body 43*a*. As a result, the peeling claw 43 is urged to the heating roller 41 in the counterclockwise direction in FIG. 2, i.e., in particular, the leading edge 43*c* is pressed against the cylindrical surface 41*b* of the heating roller 41 with a predetermined force. When the leading edge 43*c* is pressed to the cylindrical surface 41*b* with the predetermined force, the peeling claw 43 does not cause any damage to the cylindrical surface 41*b* of the heating roller 41.

A remove assistance member 45*b* is formed integrally with the frame 45 above the peeling claw 43. As a result, the remove assistance member 45*b* is fixedly assembled in the main body casing 2 of the laser printer 1. Accordingly, when a paper jam occurs between the peeling claw 43 and the guide member 44, the peeling claw 43 is moved upward along the groove 45*a* due to the jammed sheet. At the same time, a portion adjacent to the leading edge 43*c* of the main body 43*a* is brought into contact with the remove assistance member 45*b* to partially rotate the main body 43*a* about the pivotal shaft 43*b* away from the heating roller 41, i.e., in the clockwise direction in FIG. 2. Accordingly, the leading edge 43*c* is moved away from the cylindrical surface 41*b* of the heating roller 41.

Referring to FIG. 3, the guide member 44 has a plurality of guide plates 44*a* arranged in the axial direction of the heating roller 41. Each of the guide plates 44*a* is formed integrally with the guide member 44, and has a guide surface 44*b* (FIG. 2) facing the peeling surface 43*d* of the peeling claw 43 by a predetermined distance. As shown in FIG. 2, the guide surface 44*b* is so configured that the sheet 3 which has passed through between the heating roller 41 and press roller 42 is brought into contact with the guide surface 44*b* to be guided upward in the sheet feeding direction.

The guide member 44 has a pivotal shaft 44*c* at a lower portion thereof. The pivotal shaft 44*c* protrudes in the axial direction of the heating roller 41. The pivotal shaft 44*c* is pivotally supported by the frame 45 to allow the guide member 44 to rotate about the pivotal shaft 44*c*. Accordingly, the guide surface 44*b* of the guide member 44 can be displaced between a near position and a far position with respect to the peeling surface 43*d* of the peeling claw 43. When the guide member 44 is at the near position, the distance between the guide surface 44*b* and the peeling surface 43*d* is shorter. On the other hand, when the guide member 44 is at the far position, the distance between the guide surface 44*b* and the peeling surface 43*d* is farther.

A torsion spring 44*s* is wound around the pivotal shaft 44*c*. One end of the torsion spring 44*s* is engaged to the frame 45, and the other end of the torsion spring 44*s* is engaged to the guide member 44. Accordingly, the guide member 44 is biased about the pivotal shaft 44*c* in the counterclockwise direction in FIG. 2, i.e., in the direction that the guide surface 44*b* comes closer to the peeling surface 43*d*. In other words, the guide member 44 is urged to remain at the near position due to an elastic force of the torsion spring 44*s*.

As shown in FIG. 3, a plurality of gears 46 are provided near the peeling claws 43 to the frame 45, with one gear 46 being positioned near one peeling claw 43. The gear 46 has a rotary shaft 46*a* extending in the same direction as the axial direction of the heating roller 41. The gear 46 is provided downstream with respect to the peeling claw 43 in the sheet feeding direction, and rotatably supported to the frame 45 about the rotary shaft 46*a*. The gear 46 has a plurality of bumps and dips arranged alternately on the outer circumference 46*b*. Accordingly, the gear 46 is easily and reliably rotated by friction between the outer circumference 46*b* of the gear 46 and a surface of the sheet 3 when the sheet 3 is passed through the gear 46. As shown in FIG. 2, the outer circumference 46*b* of the gear 46 protrudes from the peeling surface 43*d* of the peeling claw 43 to the guide member 44 in a vertical plane to the rotary shaft 46*a*. With the above configuration, the gear 46 functions to separate the sheet 3, that has been guided by the peeling surface 43*d* of the peeling claw 43, from the peeling surface 43*d*.

As shown in FIG. 3, a plurality of ribs 47 are provided to the frame 45 in the axial direction of the heating roller 41. Two ribs 47 which are adjacent to each other are paired to interpose the peeling claw 43 and the gear 46 therebetween. The rib 47 protrudes from the peeling surface 43*d* to the guide member 44 in the vertical plane, as shown in FIG. 2. Similarly to the gear 46, the rib 47 functions to separate the sheet 3 which has been fed by the peeling surface 43*d* of the peeling claw 43 from the peeling surface 43*d*.

The guide member 44 is provided with a detection lever 48. The detection lever 48 is positioned on the downstream side of the heating roller 41 and press roller 42 in the sheet feeding direction. As shown in FIG. 3, the detection lever 48 has a lever portion 48*a*, a pivotal shaft 48*b*, and a shield plate 48*c*, which are formed integrally together. The lever portion 48*a* is positioned at the center of the width of the guide member 44. The lever portion 48*a* has a bar shape. The pivotal shaft 48*b* passes through one end of the lever portion 48*a* so as to attach the detection lever 48 to the frame 45.

The detection lever 48 is movably supported to the guide member 44 as to be pivotable between a falling position and a standing position about the pivotal shaft 48*b*. The lever portion 48*a* is fell down rearwards in the falling position when the lever portion 48*a* contacts with the sheet 3 therewith. On the other hands, the lever portion 48*a* remains upright vertically in the standing position when the lever portion 48*a* is not contact with the sheet 3.

The detection lever 48 is urged by a torsion spring 48*d* so as to return to the standing position. Referring to FIG. 2, one end of the torsion spring 48*d* is engaged to a boss 48*e* formed on one side of the lever portion 48*a*. The other end of the torsion spring 48*d* is engaged to a boss 44*d* formed on the guide member 44. Accordingly, the leading edge of the sheet 3 that has passed between the heating roller 41 and press roller 42 can be brought into contact with the lever portion 48*a*.

The lower end of the lever portion 48*a* is connected to the pivotal shaft 48*b* extending in parallel with the axial direction of the heating roller 41. The pivotal shaft 48*b* is pivotally supported to the guide member 44. One end of the pivotal shaft 48*b* protrudes from one end of the guide member 44 in a width direction thereof (a left-right direction in FIG. 3), as shown in FIG. 3. The shield plate 48*c* is formed integrally at the one end of the pivotal shaft 48*b*. The shield plate 48*c* lies in a plane orthogonal to the axial direction of the pivotal shaft 48*b* and extends from the pivotal shaft 48*b* to the front direction of the laser printer.

An optical sensor 49 is provided at the right end portion of the frame 45. The optical sensor 49 has a light-emission portion 49*a* and a light reception portion 49*b*. The light emission portion 49*a* and the light reception portion 49*b* are disposed opposite to each other, so that a light beam emitted from the light emission portion 49*a* is received by the light reception portion 49*b*. In other words, the light beam travels from the light emission portion 49*a* to the light reception portion 49*b*. The optical sensor 49 is connected to a controller 60 for controlling the operation of the laser printer 1. The controller 60 is assembled in the main body casing 2.

When the sheet 3 is not passing or when a paper jam does not occur, the shield plate 48*c* is positioned between the light emission portion 49*a* and the light reception portion 49*b*. Specifically, when the guide surface 44*b* of the guide member 44 is located near the peeling surface 43*d* and the detection lever 48 is located at the standing position, the shield plate 48*c* is positioned between the light emission portion 49*a* and the light reception portion 49*b*.

That is, the passage of the sheet 3 and occurrence of a paper jam can be detected based on a light detection signal generated by the optical sensor 49 which receives the light beam.

The optical sensor 49 can detect the movement of the guide member 44 as well as the passage of the sheet 3. When the sheet 3 comes to the guide member 44, the detection lever 48 is pivoted to move the shield plate 48*c* upward from the position between the light emission portion 49*a* and the light reception portion 49*b*. On the other hand, when the guide member 44 is pivoted about the pivotal shaft 44*c*, the shield plate 48*c* is simultaneously displaced rearward since the detection lever 48 is supported to the guide member 44. As a result, the shield plate 48*c* is moved away from the position between the light emission portion 49*a* and the light reception portion 49*b*.

Next, the operational relationship between the shield plate 48*c* and the optical sensor 49 will be explained together with the operations of the guide member 44 and the detection lever 48.

When the guide surface 44*b* of the guide member 44 is located near the peeling surface 43*d* and the detection lever 48 is located in the falling position, the shield plate 48*c* is moved upward and out of the position between the light emission portion 49*a* and the light reception portion 49*b*.

When the guide surface 44*b* is located away from the peeling surface 43*d* and the detection lever 48 is located in the falling position, the shield plate 48*c* is moved upward and rearward out of the position between the light emission portion 49*a* and the light reception portion 49*b*.

When the guide surface 44*b* is located away from the peeling surface 43*d* and the detection lever 48 is located in the standing position, the shield plate 48*c* is moved rearward out of the position between the light emission portion 49*a* and the light reception portion 49*b*.

As described above, if the detection lever 48 remains at the falling position for at least a predetermined time period due to a force applied from the sheet 3, or if the guide surface 44*b* is located far from the peeling surface 43*d* for the predetermined time period due to the force applied from the sheet 3, it is considered that a paper jam occurs near the guide member 44 and the peeling claw 43, which is detected by the optical sensor 49. It is noted that the predetermined time period is a standard for determining whether the paper jam has occurred in the fixing device 40.

Figure 4A:
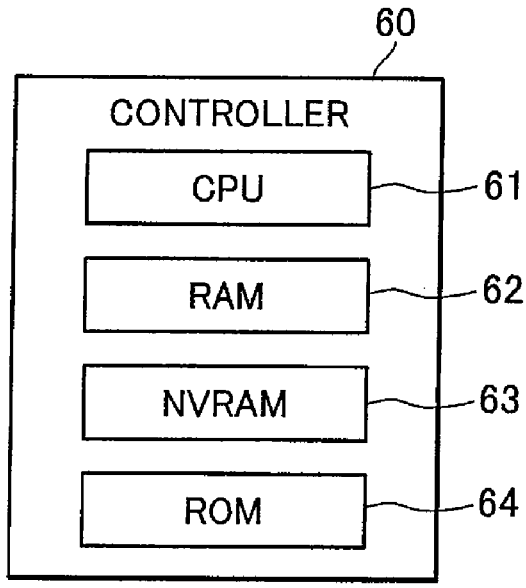
FIG. 4A is a block diagram of a controller.
Figure 4B:
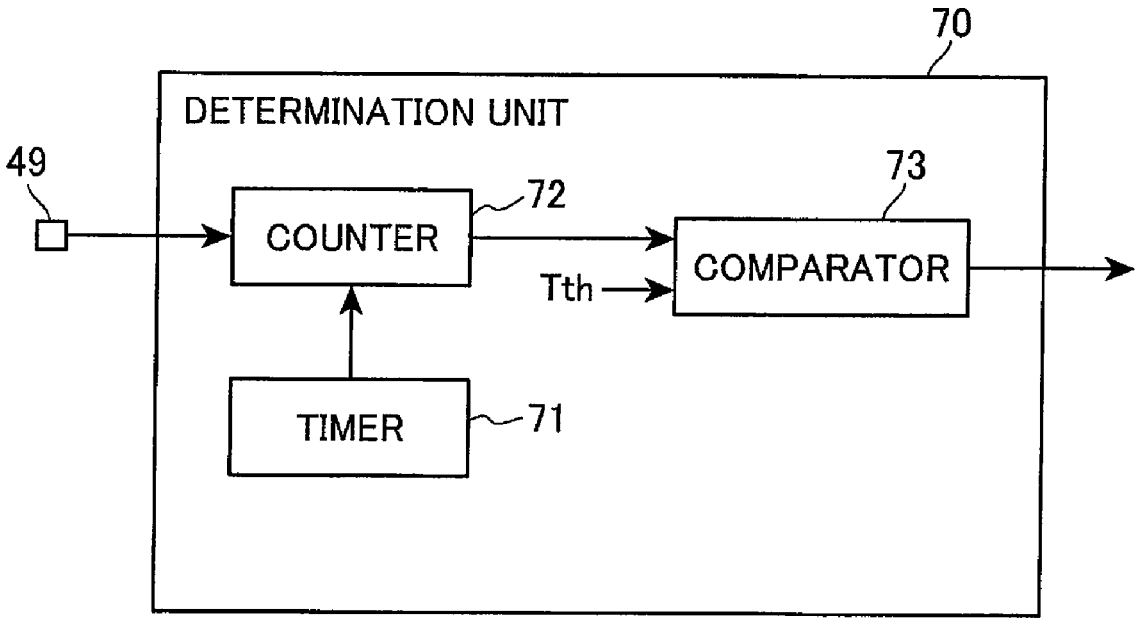
FIG. 4B is a block diagram of a determination unit.

The light detection signal of the optical sensor 49 is sent to the controller 60 as shown in FIG. 4A. The controller 60 includes a CPU 61, a RAM 62, a nonvolatile random access memory (NVRAM) 63, and a ROM 64. The CPU 61 reads out and executes a program stored in the ROM 64 and a setting value stored in the NVRAM 63 according to the usage of the laser printer 1 to control the operation of the laser printer 1. The controller 60 implements the program as a determination unit 70 for detecting the passage and jam of the sheet 3 based on the light detection signal from the optical sensor 49. The determination unit 70 includes a timer 71, a counter 72, and comparison section 73, as shown in FIG. 4B.

The timer 71 generates an oscillation signal in order to measure the light detection time at the light reception portion 49*b* of the optical sensor 49. The counter 72 receives the oscillation signal from the timer 71 and the light detection signal of the optical sensor 49. The counter 72 sends the light reception time period to the comparison section 73 based on the received oscillation signal. The comparison section 73 compares a predetermined time period Tth and the light reception time period to output a state signal of the sheet 3. The predetermined time period Tth has been stored in the controller 60. Specifically, when the comparison section 73 receives the light reception time period which is shorter than the predetermined time Tth, the comparison section 73 outputs a signal indicating passage of the sheet 3. When the comparison section 73 receives the light reception time period which is longer than the predetermined time Tth, the comparison section 73 outputs another signal indicating occurrence of a paper jam, which means that at least one of the detection lever 48 and the guide member 44 is felt down rearward.

Figure 5:
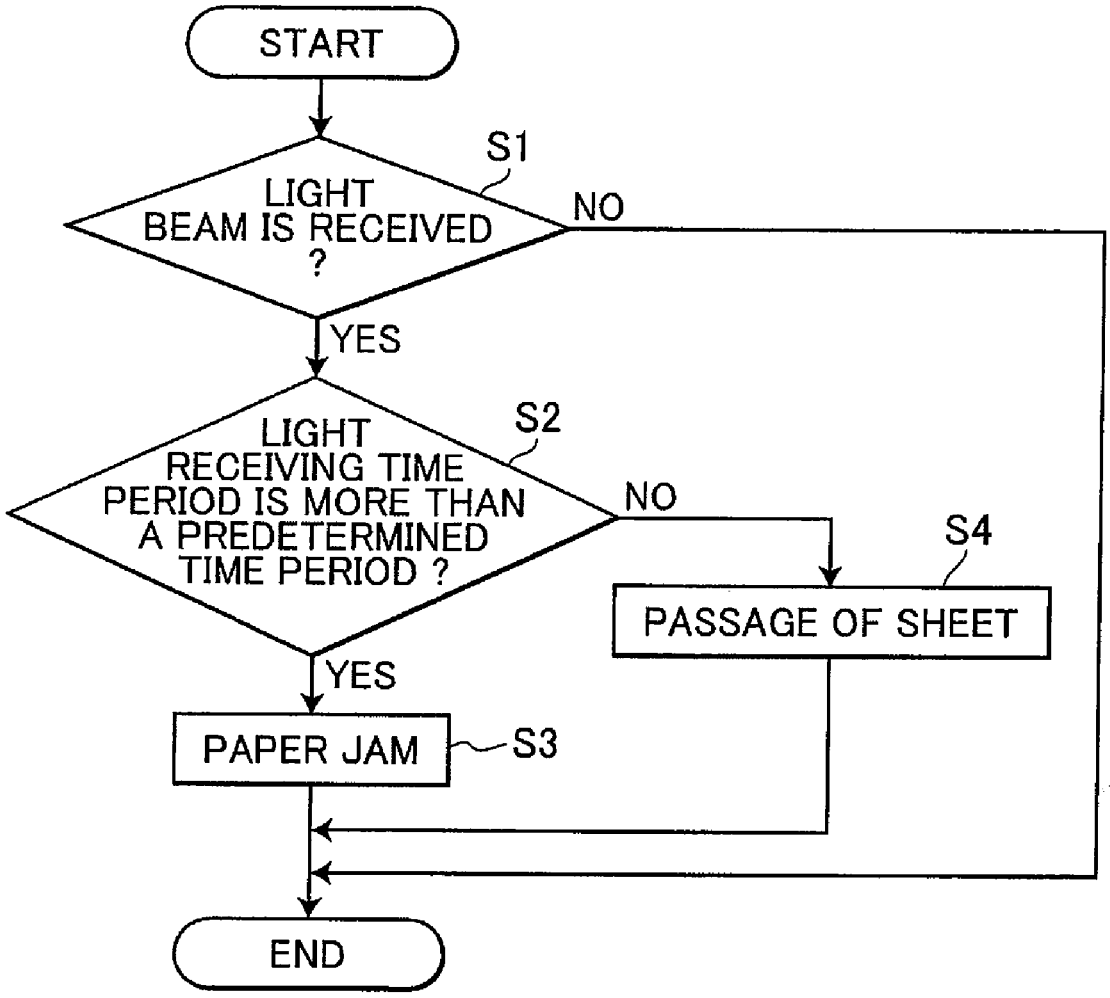
FIG. 5 is a flowchart showing a processing performed by the determination unit.

With the above configuration, the determination unit 70 performs a determination processing, as shown in FIG. 5. The determination unit 70 first determines whether the light beam is detected at the light reception portion 49*b* (S1). If the light beam is not detected (S1;No), the determination unit 70 determines that a paper jam does not occur, and finishes the processing. If the light beam is detected (S1;Yes), the determination unit 70 starts the counter 72 and determines whether the light beam has been received for the predetermined time period (S2). If the light beam has been received for the predetermined time period (S2;Yes), the determination unit 70 determines that the paper jam has occurred (S3). If the time period for receiving the light beam is less than the predetermined time period (S2;No), the determination unit 70 determines that the sheet 3 has passed without any trouble (S4).

As shown in FIG. 1, the fixing device 40 thermally fixes toner on the sheet 3 while passing the sheet 3 between the heating roller 41 and press roller 42. The sheet 3 is then transferred along a sheet discharge path 51 by means of the guide member 44. The sheet 3 that has been fed to the sheet discharge path 51 is discharged onto a sheet discharge tray 53 by means of a sheet discharge roller 52. Alternatively, the sheet 3 is fed back to the inside of the main body casing 2 by the a reverse rotation of the sheet discharge roller 52 or switching of a flapper 54, and re-supplied to the upstream of the image forming section 5 by means of a plurality of reverse feeding rollers 55 for double-sided printing.

The operation of the laser printer 1 will be described as follows.

As shown in FIG. 1, when the laser printer 1 starts a printing operation, the recording sheet 3 is pushed up from the sheet supply tray 11 by the sheet pressing plate 12 and fed to the image forming section 5 through the rollers 13 to 16. Subsequently, a toner image formed on the photoconductive drum 33 is transferred onto the sheet 3 by the process cartridge 30.

Then, the sheet 3 onto which the toner image has been transferred is thermally-fixed by the fixing device 40, while being held between the heating roller 41 and the press roller 42.

The sheet 3 onto which the toner image has thermally been fixed passes through the heating roller 41. At this time, since the leading edge 43*c* of the peeling claw 43 is biased by the torsion spring 43*s* to the cylindrical surface 41*b* of the heating roller 41, as shown in FIG. 2, the leading edge 43*c* peels off the end portion of the sheet 3 from the heating roller 41. Subsequently, the sheet 3 is fed to the rear side along the peeling surface 43*d* of the peeling claw 43.

Then, the sheet 3 is brought into contact with the outer circumference 46*b* of the gear 46, because the outer circumference 46*b* protrudes from the peeling surface 43*d* to the guide member 44 in the vertical plane. The sheet 3 is then separated from the peeling surface 43*d* while the gear 46 is rotated by a friction with the outer circumference 46*b* of the gear 46. Since the gear 46 is configured to be rotatable, the gear 46 does not act as a resistance against the feeding of the sheet 3. Accordingly, the sheet 3 is smoothly fed rearward. Further, the sheet 3 is then brought into contact with the rib 47 provided near the gear 46 to be separated from the peeling surface 43*d*. The separated sheet 3 is guided upward by the guide surface 44*b* of the guide member 44, passed through the sheet discharge path 51, and discharged onto the sheet discharge tray 53. When the sheet 3 is stuck to the heating roller 41, the sheet 3 may directly be fed to the sheet discharging path 51 without contacting with the guide member 44.

Figure 6:
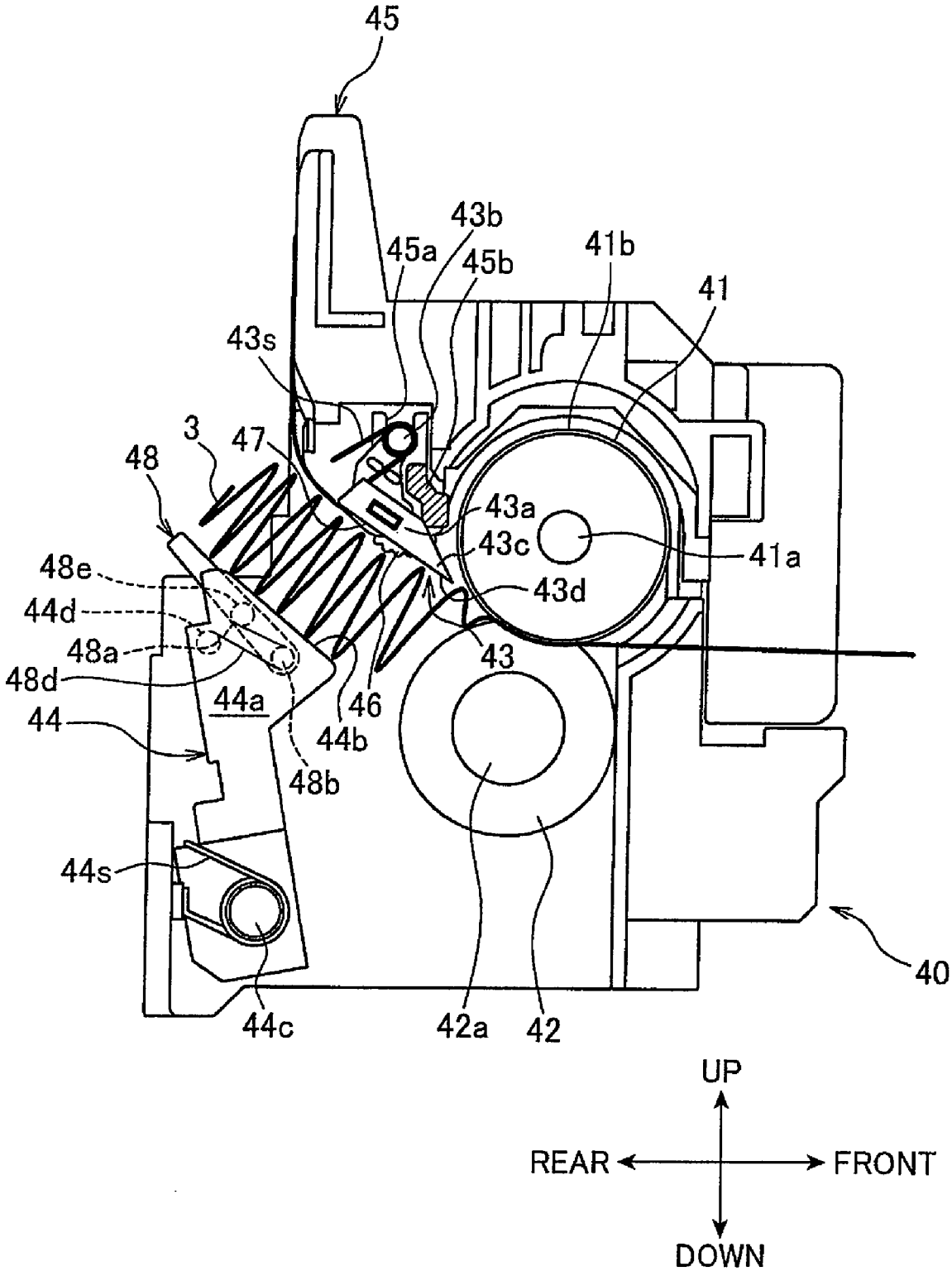
FIG. 6 is a side view showing the fixing device when a paper jam occurs.
Figure 7:
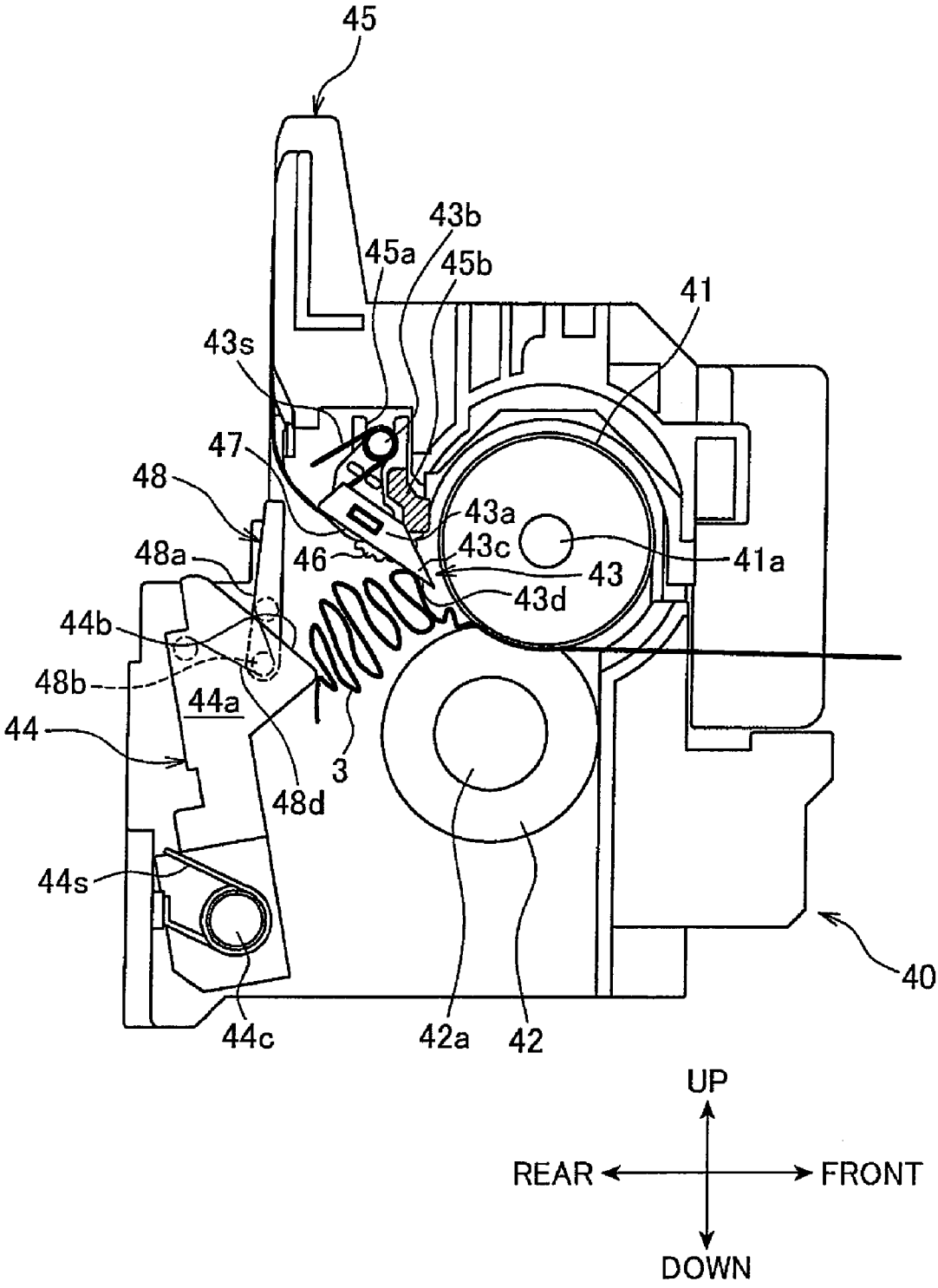
FIG. 7 is a side view showing the fixing device when the different type of the paper jam from that of FIG. 6 occurs.

The sheet 3 is accidentally jammed on the rear side of the heating roller 41 and the press roller 42. In this case, as shown in FIG. 6, the sheet 3 is pushed into between the peeling surface 43*d* of the peeling claw 43 and the guide surface 44*b* of the guide member 44 in a crumpled state. Then, a pressure is applied from the sheet 3 to the guide surface 44*b*, and the guide member 44 is then pivoted about the pivotal shaft 44*c* to the rear side against the biasing force of the torsion spring 44*s*. Therefore, an excessive load is not applied to the peeling surface 43*d* of the peeling claw 43, thereby preventing the surface of the heating roller 41 from being scratched by the leading edge 43*c* of the peeling claw 43.

If the peeling surface 43*d* of the peeling claw 43 is kept to be strongly pressed to the heating roller 41 by the sheet 3 in spite of the rearward movement of the guide member 44, e.g., if the recording sheet 3 is sequentially pushed into between the guide member 44 and peeling claw 43 and a crumpled mass of the sheet 3 is becoming bigger, the peeling claw 43 is pushed up. In this case, the pivotal shaft 43*b* is moved upward along the groove 45*a*. Then, the leading edge 43*c* of the peeling claw 43 is brought into contact with the remove assistance member 45*b* disposed above the peeling claw 43 and then pushed out to the rear side about the pivotal shaft 43*b*. Thus, the peeling claw 43 is pushed up while being rotated in the clockwise direction about the pivotal shaft 43*b*. As a result, the leading edge 43*c* is removed away from the cylindrical surface 41*b* of the heating roller 41.

Thus, even if a large load generated by the crumpled sheet 3 is applied to the peeling surface 43*d*, the leading edge 43*c* of the peeling claw 43 is moved away from the cylindrical surface 41*b* of the heating roller 41, preventing the cylindrical surface 41*b* of the heating roller 41 from being scratched.

When the sheet 3 is normally fed without an occurrence of a paper jam, the sheet 3 is brought into contact with the detection lever 48 to pivot the detection lever 48 to the falling position periodically. Therefore, the state of the optical sensor 49 is periodically switched between a state in which the light beam is blocked by the shield plate 48*c* and another state in which the light beam is received by the light reception portion 49*b*. In this case, the determination unit 70 determines that the sheet 3 is fed normally without the occurrence of a paper jam.

On the other hand, when the sheet 3 is jammed on the rear side of the heating roller 41, e.g., when the sheet 3 is jammed so as to lay down the detection lever 48 to the rear side as shown in FIG. 6, the reception portion 49*b* continues receiving the light beam from the light emission portion 49*a* in spite of the rearward movements of the detection lever 48 and/or the guide member 44. Therefore, the determination unit 70 determines occurrence of a paper jam when determining that the light reception portion 49*b* has continuously received the light beam for the predetermined time period.

Figure 8:
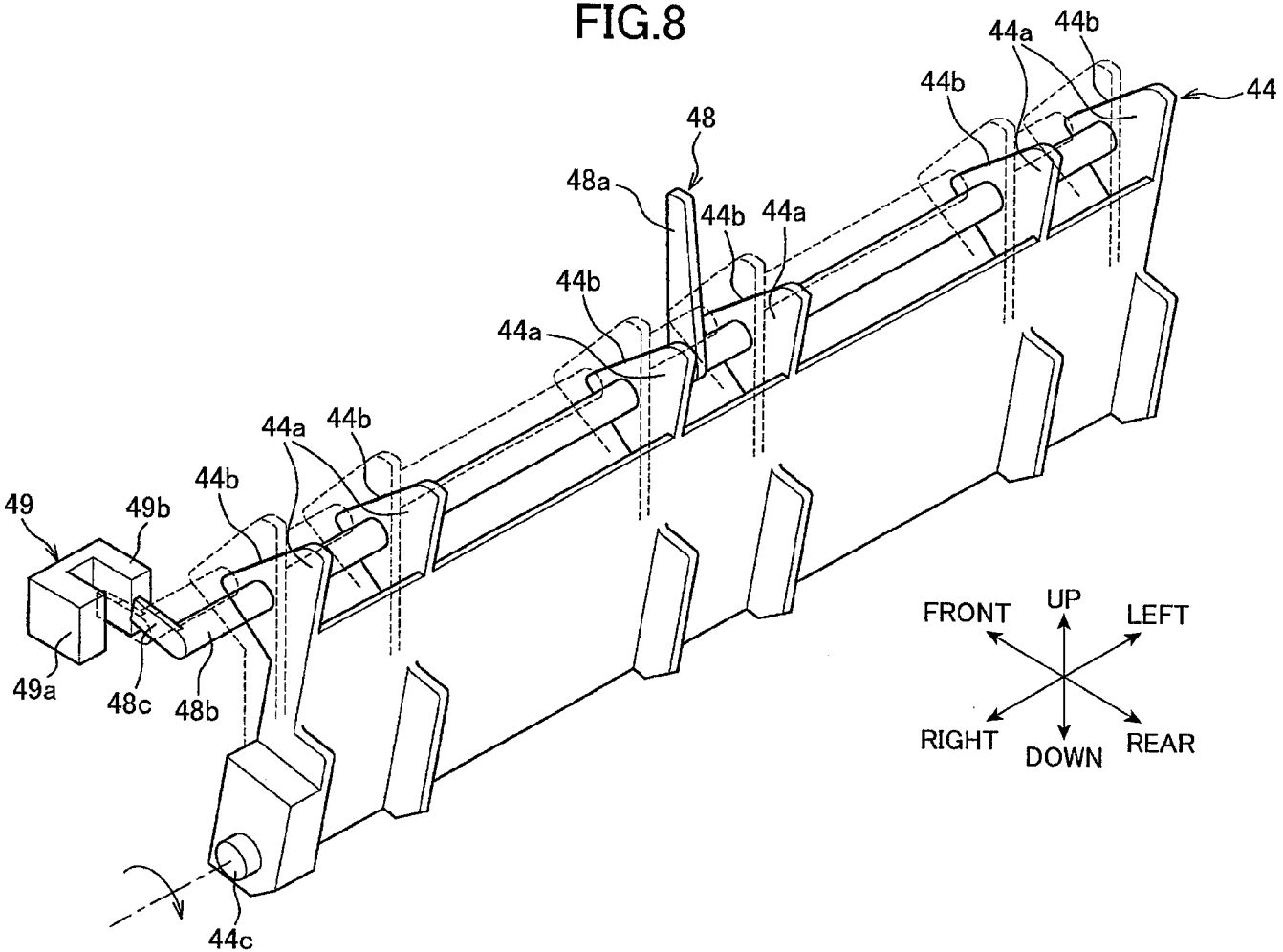
FIG. 8 is a perspective view showing a relationship between an optical sensor, a guide member, and a detection lever.

On the other hand, when the paper jam occurs, as shown in FIG. 6, the detection lever 48 is not laid down, but the guide member 44 is laid down to the rear side, the detection lever 48 supported to the guide member 44 is displaced to the rear side, as shown in FIG. 8. Accordingly, the shield plate 48*c* is moved out of the position between the light emission portion 49*a* and the light reception portion 49*b*. The light reception portion 49*b* then continues receiving the light beam from the light emission portion 49*a*, and the determination unit 70 determines the occurrence of a paper jam when determining that the light reception portion 49*b* has continuously received the light beam for the predetermined time period.

When the paper jam happens, the jammed sheet 3 presses the guide member 44 to the rear side to fall down the guide member 44 about the pivotal shaft 44*c*, the damage of the heating roller 41 caused by the peeling claw 43 can be prevented.

The lever portion 48*a* is provided at the center of the width of the guide member 44, so that the condition of the sheet 3 can be reliably detected.

According to the fixing device 40 of the present embodiment, even if the paper jam occurs on the rear side of the heating roller 41, the guide member 44 is laid down to the rear side, thereby preventing the peeling claw 43 from scratching the cylindrical surface 41*b* of the heating roller 41. Further, even if the sheet 3 is going to strongly press the peeling claw 43 to the heating roller 41, the leading edge 43*c* is removed away from the cylindrical surface 41*b* of the heating roller 41, while the peeling claw 43 is moved upward along the groove 45*a*. This structure prevents the peeling claw 43 from scratching the cylindrical surface 41*b* of the heating roller 41 when the paper jam occurs in the fixing device 40.

Further, when the guide member 44 is laid down, the paper jam can be detected by the displacement of the detection lever 48. And the determination unit 70 then determines that the paper jam has occurred. Accordingly, the paper jam can be detected without providing an additional new sensor in the main body casing 2, so that a user of the laser printer 1 can notice the occurrence of the paper jam.

Further, the gear 46 and the rib 47 separate the sheet 3 from the peeling surface 43*d* of the peeling claw 43 readily. Accordingly, the sheet 3 can smoothly be fed. Even if the sheet 3 is guided by the gear 46 and then coming into contact with the peeling claw 43 again, the rib 47 separates the sheet 3 away from the peeling claw 43. This structure enhances preventing the sheet 3 to be jammed near the peeling surface 43*d*. Accordingly, an occurrence of the paper jam near the peeling claw 43 can be reliably prevented. Further, the damage of the heating roller 41 by the peeling claw 43 can be reliably prevented.

The gear 46 protrudes from the rib 47 to the guide member 44 in the vertical plane. This structure prevents toner on the sheet 3 from being transferred to the rib 47. Accordingly, the occurrence of the paper jam near the peeling claw 43 caused by the larger friction of the rib 47 can be prevented.

The plurality of ribs 47 are provided in the width direction of the frame 45 at intervals, so that the sheet 3 can be reliably transferred.

The plurality of guide plates 44*a* assist guiding the sheet 3 having the thermally-fixed image reliably. Accordingly, the paper jam of the sheet 3 near the peeling claw 43 is reliably prevented.

The present invention has been described with reference to the above embodiment. However, the present invention is not limited to the above embodiment, but modifications and changes are within the scope of the claims.

The present invention is applicable to any other types of image forming devices such as a copier and/or a multi function printer.

Instead of the gear 46 described above, a roller with a smooth outer circumference can be employed.

Instead of the shield plate 48*c*, a bar-like shield member can be employed. In another embodiment, the shield plate 48*c* is positioned out of the position between the light emission portion 49*a* and the light reception portion 49*b* when the sheet 3 does not pass between the peeling claw 43 and the guide member 44. And, the detection lever 48 is pivoted to block the light beam when the sheet 3 is passing. In this case, the shape and position of the shield plate 48*c* are determined such that the shield plate 48*c* blocks the light beam from the light emission portion 49*a* when the guide plate 44 is laid down to the rear side.

In another embodiment, the light emission portion 49*a* does not face the light reception portion 49*b*, but a light beam emitted from the light emission portion 49*a* can be guided to the light reception portion 49*b* by means of any type of a reflecting member.

Figure 9:
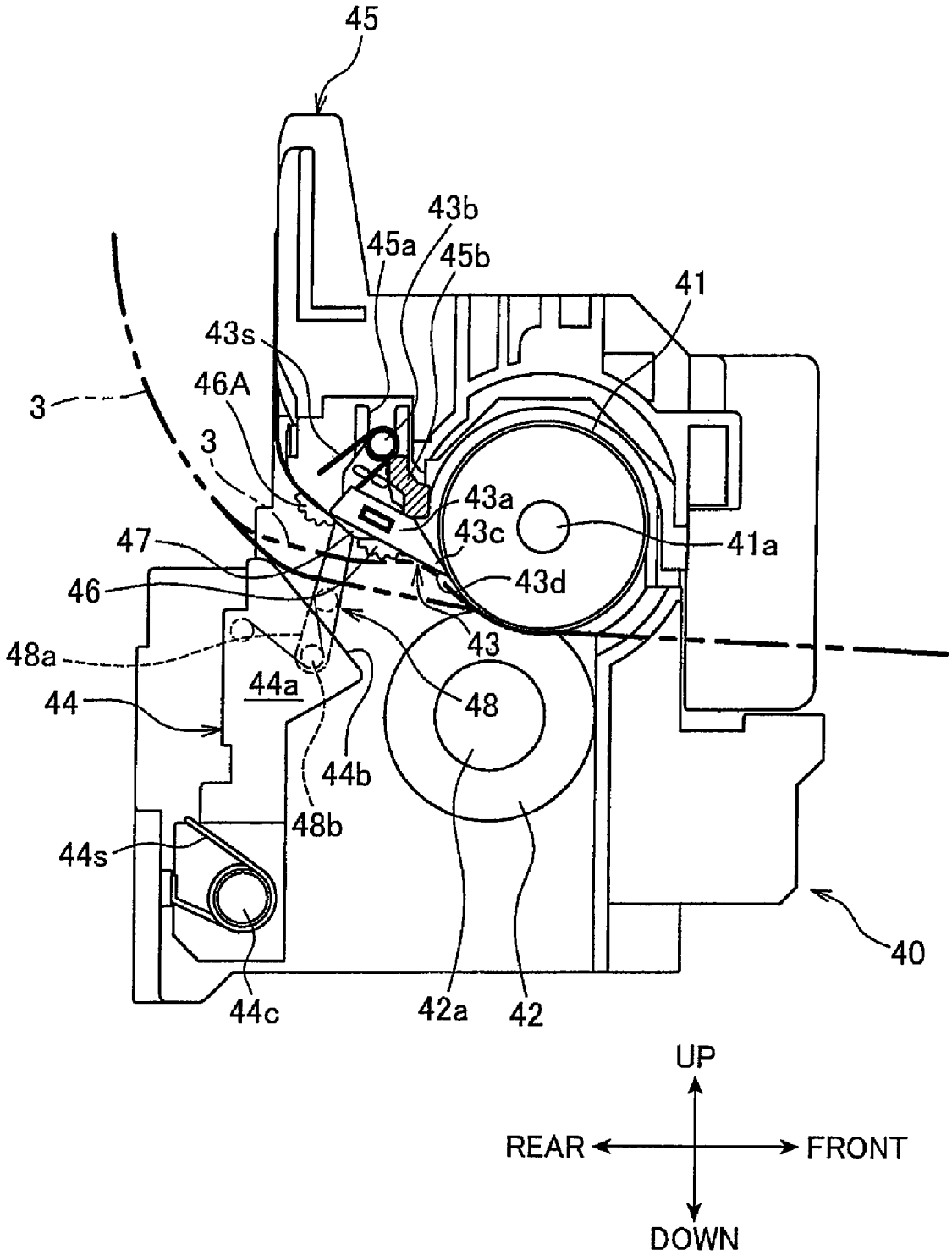
FIG. 9 is a side view showing another embodiment of the fixing device.

In another embodiment, another gear 46A can be provided to the frame 45 on the downstream side of the rib 47 in the sheet feeding direction, as shown in FIG. 9. The gear 46A protrudes from the rib 47 to the guide member 44 in the vertical plane. The above structure enhances the feed of the sheet 3. The above structure prevents a part of toner image fixed to the sheet 3 from being deposited to the rib 47.

What is claimed is:

1. A fixing device, comprising:

a frame;

a heating roller provided to the frame to produce heat, the heating roller having a roller rotation axis and a cylindrical surface;

a press roller pressed against the cylindrical surface to feed a recording medium together with the heating roller along a feeding path;

a peeler provided to the frame and having a peeling surface having a leading edge, the leading edge facing the cylindrical surface to peel off the recording medium on the cylindrical surface, the peeling surface facing the feeding path;

a guide member positioned facing the peeling surface to guide the recording medium which has passed through between the heating roller and the press roller to downstream of the feeding path, the guide member configure to be movable between a near position and a far position during operation of the fixing device, the near position being closer to the peeling surface than the far position;

a first bias unit that biases the guide member to the near position;

a wheel supported to the frame and having a wheel rotation axis and a circumferential edge, the wheel rotation axis being parallel to the roller rotation axis, the wheel being positioned in a manner that a part of the circumferential edge protrudes from the peeling surface toward the guiding member and returns to the peeling surface in a virtual perpendicular to the wheel rotation axis;

a remove assistance member provided to the frame;

a rib provided to the frame and protruding from the peeling surface to the guide member in the virtual plane;

a detection member supported by the guide member on a downstream side with respect to the heating roller in the feeding path, the detection member being displaceable when contacting with the recording medium;

an optical sensor fixed to the frame, and having a light emitter for emitting a light beam and a light receiver for receiving the light beam traveling from the light emitter to the light receiver;

a blocking member that interlocks with the detection member, the blocking member moving between a light block state and a light passing state in accordance with the displacement of at least one of the detecting member and the guide member; and a controller that determines whether a jam of the recording medium has occurred based on a movement of the blocking member, wherein the leading edge of the peeling surface is removed in a first direction away from the heating roller when a force having a predetermined value or more is exerted on the peeling surface, wherein the peeler has a back surface opposite to the peeling surface and a distal edge opposite to the leading edge, the distal edge being movably supported by a shaft which is movable in a second direction away from the guide member, wherein the remove assistance member is brought into contact with the back surface of the peeler to remove the leading edge of the peeler away from the heating roller when the peeler removes away from the guide member together with the shaft in the second direction;

wherein the rib is positioned on the downstream side with respect to the wheel in the feeding path; and wherein the blocking member is in the light blocking state when the guide member is at the near position, and in the light passing state when the guide member is at the far position.

2. The fixing device according to claim 1, wherein the circumferential edge of the wheel is positioned closer to the guiding member than the rib.

3. The fixing device according to claim 1, further comprising a plurality of ribs provided to the frame in an axial direction of the wheel rotation axis at intervals, locating the peeler and the wheel between adjacent ones of the plurality of ribs.

4. The fixing device according to claim 1, further comprising a groove that receives the shaft, the groove being configured to guide the shaft so as to remove the peeler away from the guide member.

5. The fixing device according to claim 1, wherein the guide member comprises a plurality of guide plates provided in intervals in a direction parallel to the roller rotation axis for guiding the recording medium.

6. The fixing device according to claim 5, wherein the guide member has a base end and a free end opposite to the base end, the base end being rotatably attached to the frame through a guide member shaft, and the plurality of guide plates are provided to a free end opposite to the base end.

7. The fixing device according to claim 1, wherein:

the detection member is movable between a standing position and a falling position, the detection member being contactable with the recording medium in the standing position, the detection member falling down toward the downstream of the feeding path in the falling position; and the fixing device further comprises a second bias unit that biases the detection member to the standing position, wherein a passage of the recording medium at the guide member in the feeding path is detected according to a displacement of the detection member.

8. The fixing device according to claim 7, wherein the guide member has a base end and a free end opposite to the base end, the base end being rotatably supported to the frame through a guide member shaft, the free end having the guide surface for guiding the recording medium, and the detection member is rotatably supported to the free end of the guide member.

9. The fixing device according to claim 7, wherein the detection member is positioned at a center with respect to a longitudinal length of the heating roller.

10. The fixing device according to claim 7, wherein:

the optical sensor is provided in proximity to one end of a longitudinal length of the heating roller for sensing a displacement of the detection member;

the fixing device further comprises a rotation shaft extending to the one end of the longitudinal length and rotatably supporting the detection member; and the blocking member is sensed by the optical sensor, and the blocking member is fixed to one end of the rotation shaft.

11. The fixing device according to claim 7, wherein the first bias unit produces a bias force greater than another bias force produced by the second bias unit.

12. The fixing device according to claim 1, wherein the frame is assembled in an image forming device for forming an image on the recording medium.

13. The fixing device according to claim 1, wherein the circumferential edge of the wheel is formed in a gear shape.

14. The fixing device according to claim 1, further comprising another wheel supported to the frame on the downstream side of the rib in the feeding path and protruding from the rib to the guide member in the virtual plane.

15. The fixing device according to claim 1, wherein the detection member is configured to be displaced during a jam of the recording medium; and wherein the controller determines that the jam has occurred when the blocking member is in the light passing state for a predetermined time period.

16. A fixing device, comprising:

a frame;

a heating roller provided to the frame to produce heat, the heating roller having a roller rotation axis and a cylindrical surface;

a press roller pressed against the cylindrical surface to feed a recording medium together with the heating roller along a feeding path;

a peeler provided to the frame and having a peeling surface having a leading edge, the leading edge facing the cylindrical surface to peel off the recording medium on the cylindrical surface, the peeling surface facing the feeding path and having a back surface facing the cylindrical surface and opposite to the peeling surface:

a guide member positioned facing the peeling surface to guide the recording medium which has passed through between the heating roller and the press roller to downstream of the feeding path, the guide member configured to be movable between a near position and a far position during operation of the fixing device, the near position being closer to the peeling surface than the far position;

a first bias unit that biases the guide member to the near position;

a rotation member supported to the frame and having a rotation axis and an outer circumference, the rotation axis being parallel to the roller rotation axis, the rotation member being positioned in a manner that a part of the outer circumference protrudes from the peeling surface toward the guiding member and returns to the peeling surface in a virtual plane perpendicular to the rotation axis;

a removed assistance member configured to contact the back surface to force the peeler away from the cylindrical surface when sufficient force is applied to the peeling surface;

a rib provided to the frame and protruding from the peeling surface to the guide member in the virtual plane;

a detection member supported by the guide member on a downstream side with respect to the heating roller in the feeding path, the detection member being displaceable when contacting the recording medium:

an optical sensor fixed to the frame, and having a light emitting for emitting a light beam and a light receiver for receiving the light beam traveling from the light emitter to the light receiver;

a blocking member that interlocks with the detection member, the blocking member moving between the light block state an the light passing state in accordance with the displacement of at least one of the detecting member and the guide member: and a controller that determines whether a jam of the recording medium has occurred based on a movement of the blocking member, wherein the rib is positioned on the downstream side with respect to the rotation member in the feeding path; and wherein the blocking member is in the light blocking state when the guide member is at the near position, and in the light passing state when the guide member is at the far position.

17. The fixing device according to claim 16, wherein the rotation member has a plurality of bumps and dips on the outer circumference.

18. The fixing device according to claim 16, wherein the frame is assembled in an image forming device for forming an image on the recording medium.

19. The fixing device according to claim 18, wherein the frame is assembled to be located on an upstream side of a curved part of the feeding path provided in the image forming device, the curved part being located close to a recording medium discharge unit provided in the image forming device.

20. The fixing device according to claim 19, wherein the guide member guides the recording medium to the curved part of the feeding path.

21. The fixing device according to claim 20, wherein the peeler is located above the feeding path, and the guide member is located below the feeding path and guides the recording medium upward to the curved part.

22. The fixing device according to claim 16, wherein the detection member configured to be displaced during a jam of the recording medium; and wherein the controller determines that the jam has occurred when the blocking member is in the light passing state for a predetermined time period.

23. A fixing device, comprising:

a frame;

a heating roller having a roller rotation axis and a cylindrical surface;

a press roller pressed against the cylindrical surface to feed a recording medium together with the heating roller along a feeding path;

a peeler having a peeling surface having a leading edge, the leading edge facing the cylindrical surface to peel off the recording medium on the cylindrical surface, the peeling surface facing the feeding path, the peeler configured to rotate about an axis, and having a back surface facing the cylindrical surface and opposite to the peeling surface;

a guide member positioned as facing the peeling surface to guide the recording medium which has passed through between the heating roller and the press roller to downstream of the feeding path, the guide member configured to be moveable between a near position and a far position during operation of the fixing device, the near position being closer to the peeling surface than the far position;

a guide supporting the peeler axis so as to permit the peeler axis to move away from the guide member during a jam of the recording medium;

a wheel supported by the frame and having a wheel rotation axis and a circumferential edge, the wheel being positioned in a manner that a part of the circumferential edge protrudes from the peeling surface toward the guiding member and returns to the peeling surface;

a remove assistance member positioned to contact the opposite surface and engage the back surface during the jam of the recording medium to separate the leading edge from the heating roller;

a rib provided to the frame and protruding from the peeling surface to the guide member in a virtual plane, a detection member supported by the guide member on a downstream side with respect to the heating roller in the feeding path, the detection member being displaceable when contacting the recording medium;

an optical sensor fixed to the frame, and having a light emitted for emitting a light beam and a light receiver for receiving the light beam traveling from the light emitter to the light receiver;

a blocking member that interlocks with the detection member, the blocking member moving between the light block state and the light passing state in accordance with the displacement of at least one of the detecting member and the guide member; and a controller that determines whether a jam of the recording medium has occurred based on a movement of the blocking member, wherein the rib is positioned on the downstream side with respect to the wheel in the feeding path; and wherein the blocking member is in the light blocking state when the guide member is at the near position, and in the light passing state when the guide member is at the far position.

24. The fixing device according to claim 23, wherein the leading edge of the peeling surface is removed in a first direction away from the heating roller during the jam of the recording medium.

25. The fixing device according to claim 23, wherein the detection member is configured to be displaced during a jam of the recording medium; and wherein the controller determines that the jam has occurred when the blocking member is in the light passing state for a predetermined time period.

* * * * *